US007145527B2

(12) United States Patent
Moon

(10) Patent No.: US 7,145,527 B2
(45) Date of Patent: Dec. 5, 2006

(54) FIELD EMISSION DISPLAY DEVICE AND DRIVING METHOD THEREOF

(75) Inventor: Seong Hak Moon, Kyeongki-Do (KR)

(73) Assignee: LG Electronics Inc., Seoul (KR)

( * ) Notice: Subject to any disclaimer, the term of this patent is extended or adjusted under 35 U.S.C. 154(b) by 587 days.

(21) Appl. No.: 10/179,288

(22) Filed: Jun. 26, 2002

(65) Prior Publication Data

US 2003/0006947 A1 Jan. 9, 2003

(30) Foreign Application Priority Data

Jun. 29, 2001 (KR) ..... 2001-38297
Jul. 19, 2001 (KR) ..... 2001-43539

(51) Int. Cl.
*G09G 3/22* (2006.01)

(52) U.S. Cl. ..... 345/75.2; 345/206

(58) Field of Classification Search ..... 345/75.2, 345/74.1, 75.1, 76, 80, 82, 204–206; 315/169.1, 315/169.2, 169.3; 313/495
See application file for complete search history.

(56) References Cited

U.S. PATENT DOCUMENTS 5,347,292 A * 9/1994 Ge et al. ..... 345/75.2
5,729,087 A * 3/1998 Chien ..... 313/495
5,841,414 A * 11/1998 Tanaka ..... 345/87
5,939,833 A * 8/1999 Song et al. ..... 315/169.1
6,081,247 A * 6/2000 Bancal ..... 345/75.1
6,552,702 B1 * 4/2003 Abe et al. ..... 345/75.2

* cited by examiner

*Primary Examiner*—Xiao Wu
(74) *Attorney, Agent, or Firm*—Fleshner & Kim, LLP

(57) ABSTRACT

A field emission display device is provided which includes data lines formed in a panel, scan lines formed in the direction crossing the data lines in the panel, a first connector installed at an end of the data lines and electrically connected with the data lines, a second connector installed at an end of the scan lines and electrically connected with the scan lines and a printed circuit board which is installed on the rear surface of the panel. The flat emission display device can display an image of a uniform brightness regardless of the position of the screen. Also, the flat emission display device can maintain the brightness of the whole screen uniformly by differently supplying the driving voltage and pulse width of the driving voltage which are supplied to the data driving unit according to the position of the data line, and compensating voltage descending caused by differences in the resistance according to the is position of the scan line by converting the input data value.

5 Claims, 8 Drawing Sheets

FIELD EMISSION DISPLAY DEVICE AND DRIVING METHOD THEREOF

BACKGROUND OF THE INVENTION

1. Field of the Invention

The present invention relates to a field emission display device and driving method, and more particularly, to a field emission display device and driving method for the same for displaying a uniform image on the apparatus by preventing voltage descending by a scan line or data line or compensating voltages applies to the respective lines, and its driving method.

2. Description of the Background Art

Recently, various flat panel display devices which can reduce weight and volume of a Cathode Ray Tube (hereinafter, as CRT) have been developed. The flat panel display device is divided to a Liquid Crystal Display (LCD), Field Emission Display (hereinafter, as FED), Plasma Display Panel, Electro-Luminescence and the like. To improve the displaying quality of the flat panel display device, researches for increasing luminescence, contrast and color purity are actively in progress.

Among them, the FED is divided into a tip type FED which emits electron using the tunnel effect by concentrating a high electric field in the acute emitter, and a flat FED which emits electron by concentrating a high electric field in a metal having a predetermined area.

The tip type FED emits electron at a conic protrusion portion which is manufactured with Si or Mo by applying an electric field at the electron emitting portion by applying a voltage to a gate electrode. Also, the flat panel FED forms a lamination structure including a metallic layer, insulation layer, semiconductor layer and the like and emits the electron outwardly form an electron emitting unit by injecting and passing electron from the metallic layer to the insulation layer.

In the tip type FED, discharging amount of electron is determined according to the characteristics of the emitter which is used for electron discharging. Therefore, every emitter must be manufactured uniformly, but with the present manufacturing process, it is difficult to manufacture an emitter uniformly and much time is taken to manufacture such emitter.

Also, in the tip type FED, since the electron is emitted from the acute emitter, a voltage of several tens to hundreds volts must be applied to cathode and gate electrodes, thus to consume much amount of power.

FIG. 1 is a drawing illustrating a cell of a field emission display (FED) in accordance with the conventional art. As shown in the drawing, each cell 100 of the flat panel FED includes an upper substrate 101 in which an anode electrode 102 and fluorescent material 103 are laminated, and a field emission array 105 which is formed on a lower substrate 104.

The field emission array 105 includes a scan electrode 108 formed on the lower substrate 104, an insulation layer 107 which is formed on the scan electrode 108 and a data electrode 106 which is formed on the insulation layer 107.

The scan electrode 108 supplies a current to the insulation layer 107, the insulation layer 107 insulates a portion between the scan electrode 108 and data electrode 106, and the data electrode 106 is used as a fetching electrode for emitting electron.

The FED in accordance with the conventional art will be described as follows.

To display an image on the display device, firstly, a scan pulse P of a negative polarity (−) is applied to the scan electrode 108 and a data pulse DP of a positive polarity (+) is applied to a data electrode 106. Then, the electrons are accelerated to the anode electrode 102 by tunneling the insulation layer 107 from the scan electrode 108 to the data electrode 106. The electrons excite the fluorescent material 103 by bumping into red, green and blue fluorescent materials 103. At this time, according to the fluorescent materials, a visible ray with a color among the red, green and blue colors is generated. Such flat panel FED can be driven with a lower voltage than that of the tip type FED, since the scan electrode 108 and data electrode 106 are installed having a predetermined area and facing each other.

Namely, voltages of only several volts to several tens of volts are applied to the scan electrode 108 and data electrode 106 of the flat panel FED and the scan electrode 108 and data electrode 106 for emitting electrons, have predetermined areas. Accordingly, the scan electrode 108 and data electrode 106 can be manufactured by a simpler manufacturing process than that of the tip type FED.

FIG. 2 is a block diagram showing a flat panel FED in accordance with the conventional art. As shown in the drawing, the flat panel FED includes a data driving unit 203 for driving the lines D1, D2, . . . , DM, a scan driving unit 201 for driving scan lines S1, S2, . . . , Sm, a first connector 202 which is installed in the lower substrate 205 and electrically connects the scan lines S1, S2, . . . , Sm and the scan driving unit 201, and a second connector 204 which is installed in the lower substrate 205 and electrically connects the data lines D1, D2, . . . , Dm and data driving unit 203.

The data driving unit 203 supplies a data pulse DP to the data lines D1, D2, . . . , Dm according to whether data are supplied and the scan driving unit 201 sequentially supplies a scan pulse SP to the scan lines S1, S2, . . . , Sm. Also, the first connector 202 is electrically connected with the scan driving unit 201 and supplies the driving signals applied from the scan driving unit 201 to the scan lines S1, S2, . . . , Sm. The second connector is electrically connected with the data driving unit 203 and supplies the driving signals applied from the data driving unit 203 to the data lines D1, D2, . . . , Dm.

FIG. 3 is a drawing illustrating a driving waveform which is supplied to the cell of the FED in accordance with the conventional art. As shown in the drawing, the scan pulse SP with negative polarity is sequentially supplied to the scan lines S1, S2, . . . , Sm of the conventional FED and data pulse DP with positive polarity which is synchronized to the scan pulse of negative polarity is supplied to the data lines D1, D2, . . . , Dm. In the cell to which the scan pulse SP and data pulse DP are supplied, electrons are emitted by voltage difference between the scan pulse SP and data pulse DP.

FIG. 4 is a drawing illustrating a cell arrangement of a general field emission display. As shown in the drawing, when the scan pulse SP of −5V is applied to the first scan line S1 and the data pulse DP of 5V is applied to the first data line D1, there occurs voltage difference of 10V in the first cell P1 which is formed in the first scan line S1.

On the other hand, since 5V, that is, only the data pulse is applied in the second to mth cells P2, . . . , Pm which are formed in the second to mth scan lines S2, . . . , Sm, the electrons are not emitted.

Then, the scan pulse SP and data pulse DP are sequentially applied to the mth scan line Sm by repeating such process and an image is displayed on the displaying device by driving the first to mth cells P1, P2, . . . , Pm. After displaying the image, the reset pulse RP with positive polarity is applied ot the first to mth scan lines S1, S2, . . . , Sm. Accordingly, electric charges which are charged in the first to mth cells P1, P2, . . . , Pm are removed.

However, the conventional FED has different voltage values of the scan pulses SP which are applied to the first position 401, second position 402, and third position 403. Namely, since the scan lines S1, S2, . . . , Sm of the FED have high resistance values, scan pulses SP with different voltage values according to the position of the scan lines S1, S2, . . . , Sm are applied by voltage descending caused by the high voltage values. For example, in case of the conventional FED of 5.3 inches, the respective scan lines S1, S2, . . . , Sm have resistance values between 100 to 150 Ω.

Therefore, in the FED in accordance with the conventional art, since different voltages are applied according to the position of the scan lines S1, S2, . . . , Sm, images with different luminances are displayed according to the position of the screen and accordingly, a uniform image could not be displayed on the FED.

Particularly, since such voltage descending phenomenon becomes more serious as the size of the FED increases, it could not manufactured with a large area.

SUMMARY OF THE INVENTION

Therefore, an object of the present invention is to provide a field emission display device and driving method for the same, capable of reducing power consumption and manufacturing the device as a large screen by minimizing the resistance value of the scan line.

Also, another object of the present invention is to provide a field emission display device and driving method for the same, capable of maintaining the brightness of a whole screen, by differently supplying the driving voltage and pulse width of the driving voltage which are supplied to the data driving driver according to the position of the data line or compensating voltage descending caused by difference in the resistance according to the position of the scan lines by converting the inputted data value.

To achieve these and other advantages and in accordance with the purpose of the present invention, as embodied and broadly described herein, there is provided a field emission display device, including data lines which are formed in a panel, scan lines which are formed in the direction crossing the data lines in the panel, a first connector which is installed at an end of the data lines and electrically connected with the data lines, a second connector which is installed at an end of the scan lines and electrically connected with the scan lines and a printed circuit board which is installed on the rear surface of the panel.

Also, there is provided a driving method for the field emission display device, including the steps of sequentially supplying a scan pulse to a plurality of scan lines, supplying a data pulse to a plurality of data lines by synchronizing the data pulse with the scan pulse and supplying a plurality of reset pulses to the plurality of scan lines.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

The field emission display (hereinafter, as FED) can solve problems of the conventional art by preventing voltage descending which is applied to the respective cells or controlling voltage which is applied to the respective cells, to improve uniformity (luminescence and the like) of respective cells. Reference will now be made in detail to the preferred embodiments of the present invention, examples of which are illustrated in the accompanying drawings.

Figure 1:
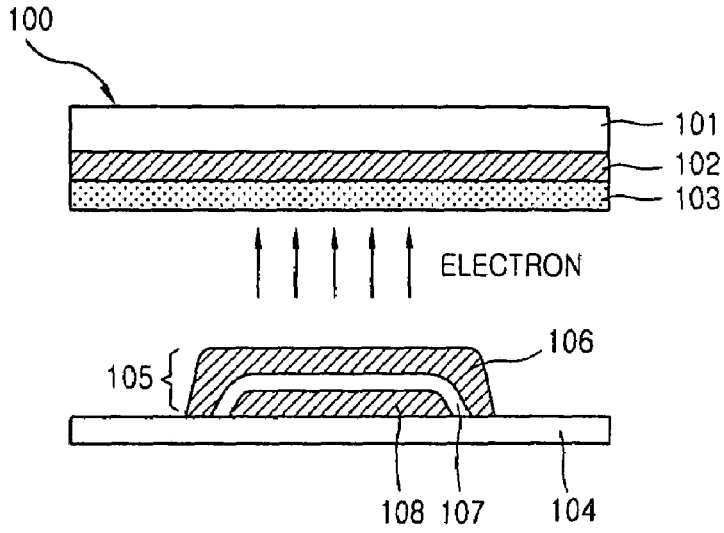
FIG. 1 CONVENTIONAL ART
FIG. 1 is a drawing illustrating a cell of a field emission display (FED) in accordance with the conventional art.
Figure 2:
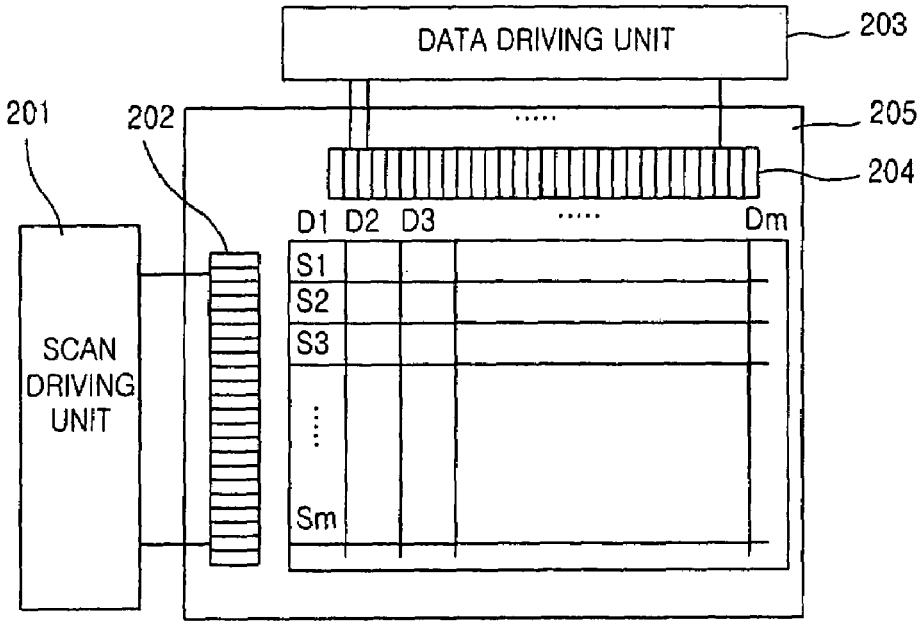
FIG. 2 CONVENTIONAL ART
FIG. 2 is a block diagram showing a FED in accordance with the conventional art.
Figure 3:
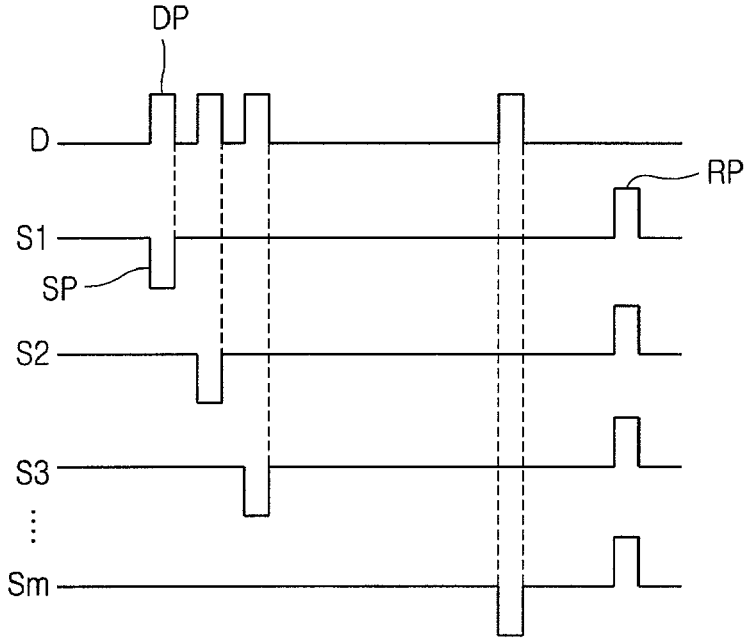
FIG. 3 CONVENTIONAL ART
FIG. 3 is a drawing illustrating a driving waveform which is supplied to the cell of the FED in accordance with the conventional art.
Figure 4:
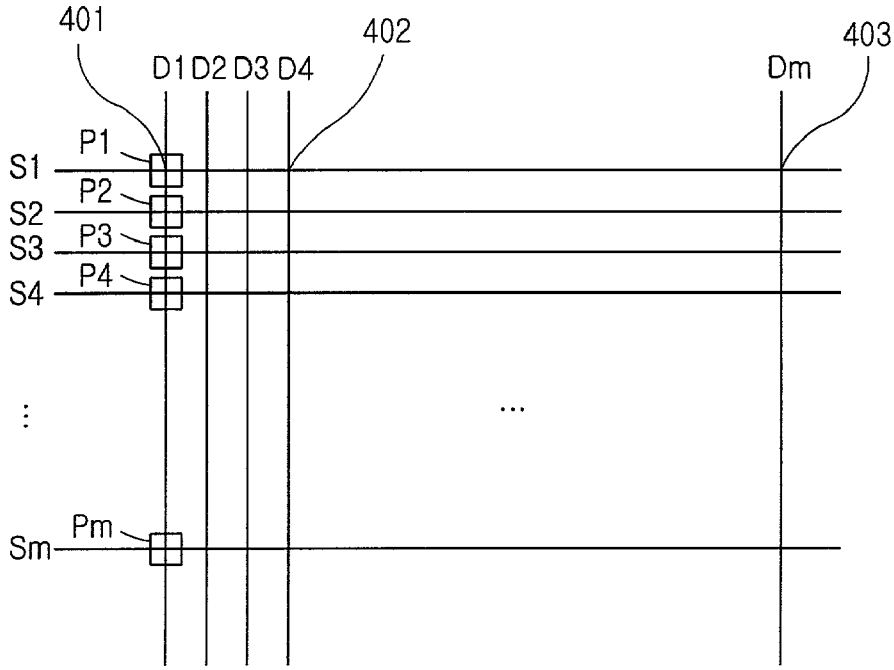
FIG. 4 CONVENTIONAL ART
FIG. 4 is a drawing illustrating a cell arrangement of a general field emission display.
Figure 5:
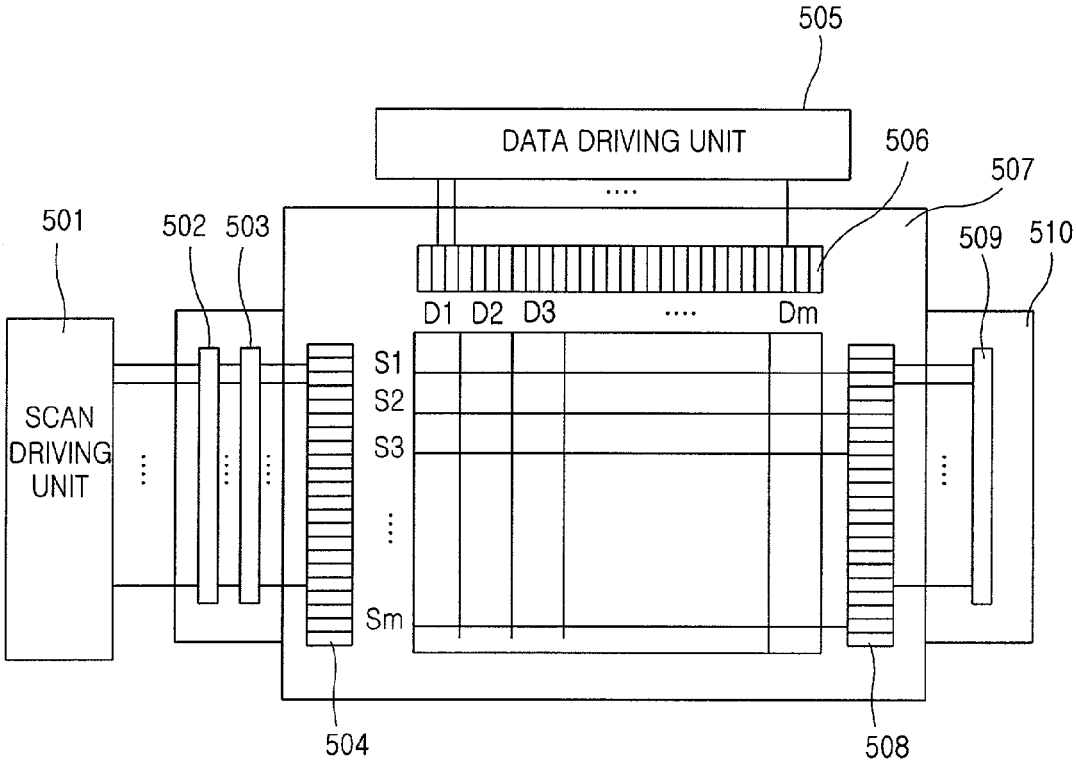
FIG. 5 is a block diagram showing a first embodiment of a FED in accordance with the present invention.

FIG. 5 is a block diagram showing a first embodiment of a FED in accordance with the present invention. As shown in the drawing, the FED includes a data driving unit 505 for driving data lines D1, D2, . . . , Dm, a scan driving unit 501 for driving scan lines S1, S2, . . . , Sm, a first connector 506 which is installed on a lower substrate and electrically connects the data lines D1, D2, . . . , Dm and data driving unit 505, second and third connectors 504 and 508 which are installed on the lower substrate 507 and electrically connect the scan lines S1, S2, . . . , Sm and the scan driving unit 501 and a printed circuit board 510 which is installed on the rear surface of the lower substrate. At this time first to third joints 502, 503 and 509 are not described.

Figure 6:
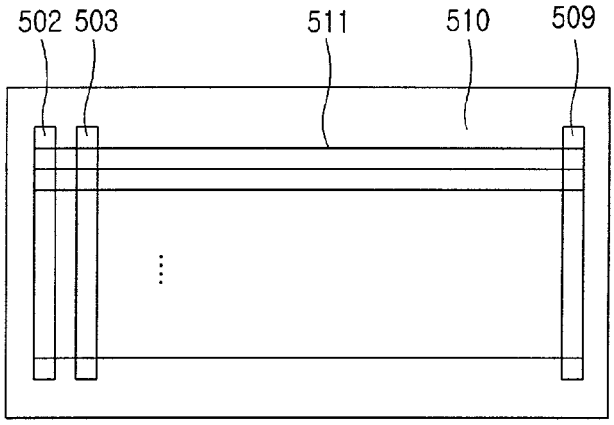
FIG. 6 is a detailed view of a printed circuit board shown in FIG. 5.

FIG. 6 is a detailed view of a printed circuit board shown in FIG. 5. As shown in the drawing, in the printed circuit board 510, first to third joints 502, 503 and 509 are installed and auxiliary electrodes 511 which are formed in a line with the scan lines S1, S2, . . . , Sm, for connecting the first to third joints 502, 503 and 509 and the scan lines S1, S2, . . . , Sm in parallel are installed.

The FED in accordance with the embodiment of the present invention with the above composition will be described in detail as follows.

The first joint 503 is electrically connected with the second connector 504 which is formed on the lower substrate, the second joint 502 is electrically connected with the, scan driving unit, and the third connector 509 is electrically connected with the third connector 508 formed in the lower substrate. When the first and third joints 503 and 509 are connected with the second and third connectors 504 and 508, the auxiliary electrode 511 and scan lines S1, S2, . . . , Sm are connected in parallel in a circuit.

At this time, since the auxiliary electrode 511 is formed with wider width and/or thickness than that of the scan line S1, the electrode has a lower resistance value than the scan line S1. Also, since the auxiliary electrode 511 and scan line S1 are connected in parallel, the resistance value of the scan line S1 is determined by the following expression (1).

$$R = \frac{R1 \times R2}{R1 + R2} \tag{1}$$

Here, R1 designates the resistance value of the scan line S1 and R2 designates the resistance value of the auxiliary electrode 511 and R designates a parallel resistance value of the scan line S1 and auxiliary electrode 511. For instance, if the resistance value of the scan line S1 is 150Ω and the resistance value of the auxiliary electrode 511 is 15Ω, the resultant resistance value of the scan line S1 and the auxiliary electrode 511 is 14Ω. That is, the resistance value of the scan line becomes 14Ω by the auxiliary electrode 511.

As described above, the first embodiment of the present invention can reduce the resistance value of the scan line S1 by using the auxiliary electrode 511 and minimize voltage descending amount in respective scan lines by having same voltages flowing in the whole scan lines S1, S2, . . . , Sm. Therefore, with the present invention, an image of a uniform brightness can be displayed regardless of the position of the screen and a FED having a large area can be manufactured.

Figure 7:
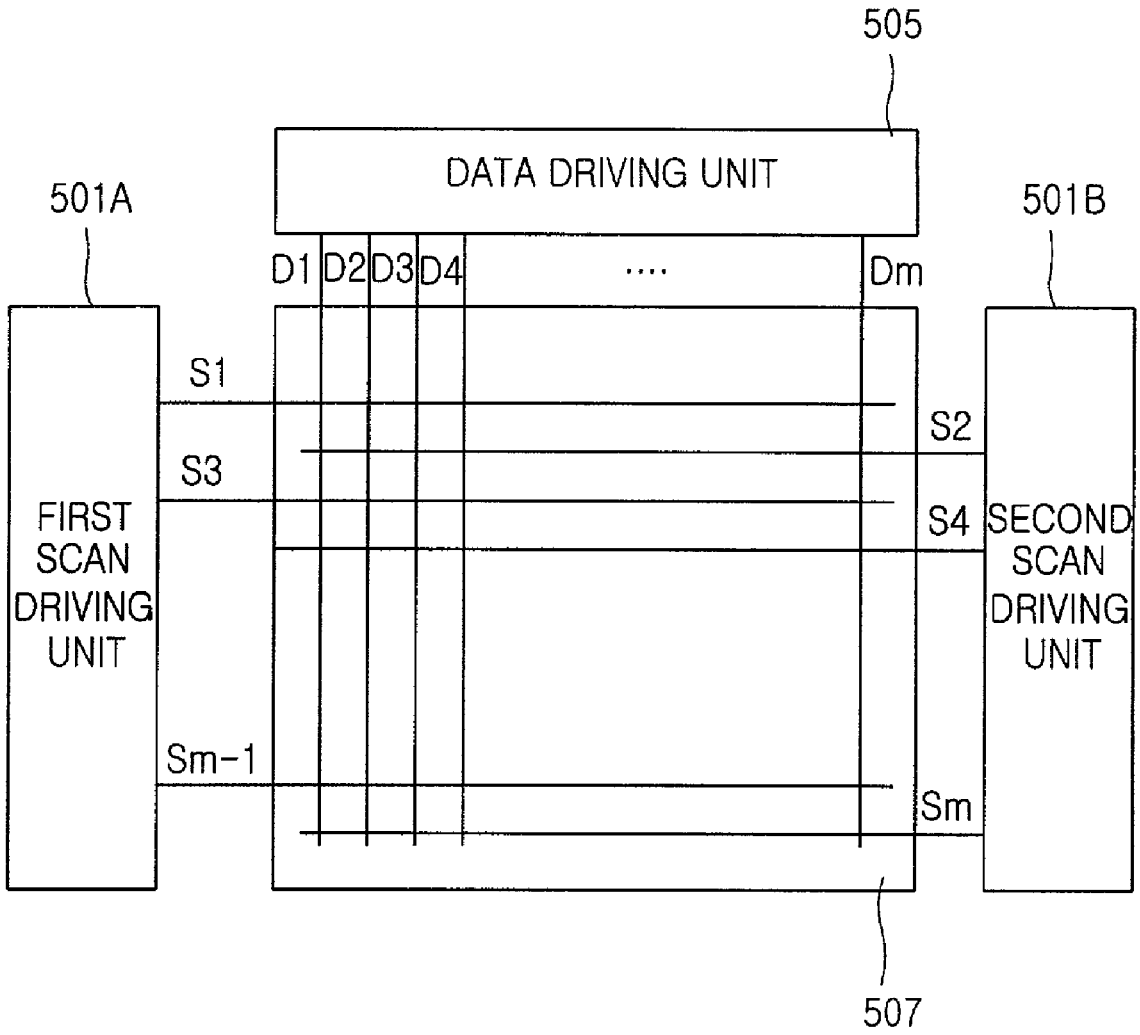
FIG. 7 is a drawing illustrating a second embodiment of the FED in accordance with the present invention.

FIG. 7 is a drawing illustrating a second embodiment of the FED in accordance with the present invention. As shown in the drawing, the FED includes a data driving unit 505 for driving data lines D1, D2, . . . , Dm formed on the lower substrate 507 of the panel, a first scan driving unit 501A for driving scan lines of odd numbers S1, S3, . . . , S2m−1, and a second scan driving unit 501B for driving scan lines of uneven numbers S2, S4, . . . , S2m.

The operation of the FED with the above composition will be described as follows.

The first scan driving unit 501A supplies a scan pulse SP to the first scan line S1 and the data driving unit 505 supplies the data pulse DP to the data lines D1, D2, . . . , Dm by synchronizing the data pulse DP with the scan pulse SP. At this time, in cells to which the scan pulse SP and data pulse DP are supplied, electrons are emitted and a predetermined image is displayed. Also, the second scan driving unit 501B supplies the scan pulse SP to the second scan line S2 and the data driving unit 505 supplies the data pulse DP to the data lines D1, D2, . . . , Dm by synchronizing the data pulse DP with the scan pulse SP. At this time, cells to which the scan pulse SP and data pulse DP are supplied emit electrons, thus to display a predetermined image.

Figure 8A:
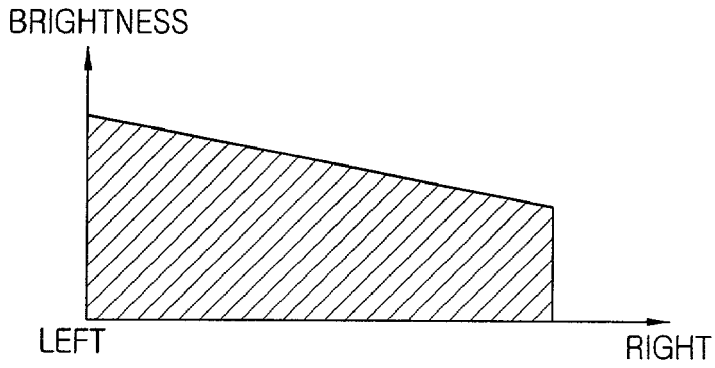
FIG. 8A is a drawing illustrating a visual change in luminance of each cell in case of driving only a first scan driving unit in accordance with the second embodiment of the present invention.
Figure 8B:
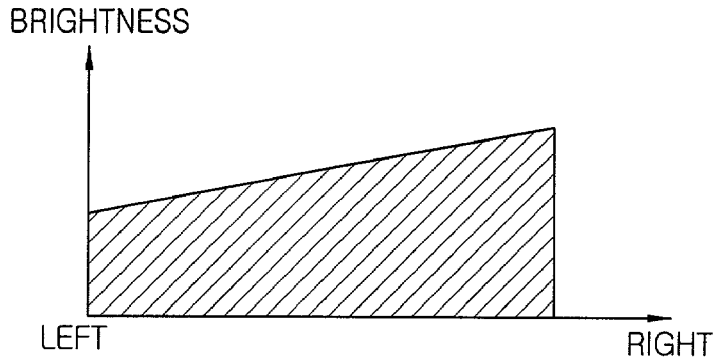
FIG. 8B is a drawing illustrating a visual change in luminance of each cell in case of driving only a second scan driving unit in accordance with the second embodiment of the present invention.

On the other hand, when the scan pulse SP is supplied to the first scan driving unit 501A, the brightness of the screen is decreased along from the left side to the right side as shown in FIG. 8A. That is, a point which is positioned farther from the first scan driving unit 501A by resistance of the scan lines S1, S2, . . . , Sm has a luminescence of lower brightness. Also, when the scan pulse SP is supplied from the second scan driving unit 501B, brightness of the screen is increased along from the left side to the right side as shown in FIG. 8B. That is, a point which is positioned farther from the second scan driving unit 501B by resistance of the scan lines S1, S2, . . . , Sm has a luminescence of lower brightness.

Figure 8C:
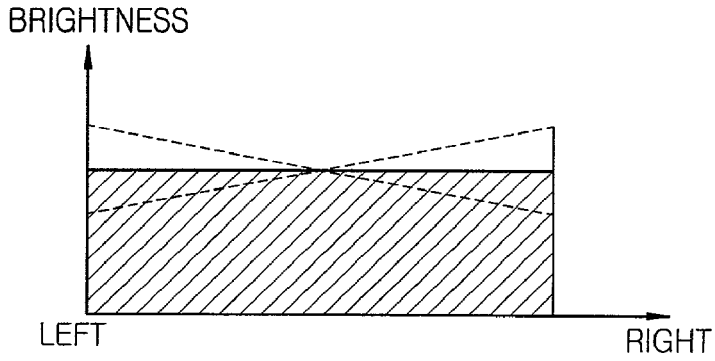
FIG. 8C is a drawing illustrating a visual change in luminance of each cell in case of driving the first and second scan driving units in accordance with the second embodiment of the present invention.

Therefore, if scan lines of odd numbers S1, S3, . . . , S2m−1 and scan lines of uneven numbers S2, S4, . . . S2m are operated in turn, the brightness of the panel is visually displayed uniformly as in FIG. 8C. Namely, an image having uniform luminescence can be displayed regardless of the position of the panel.

Figure 9:
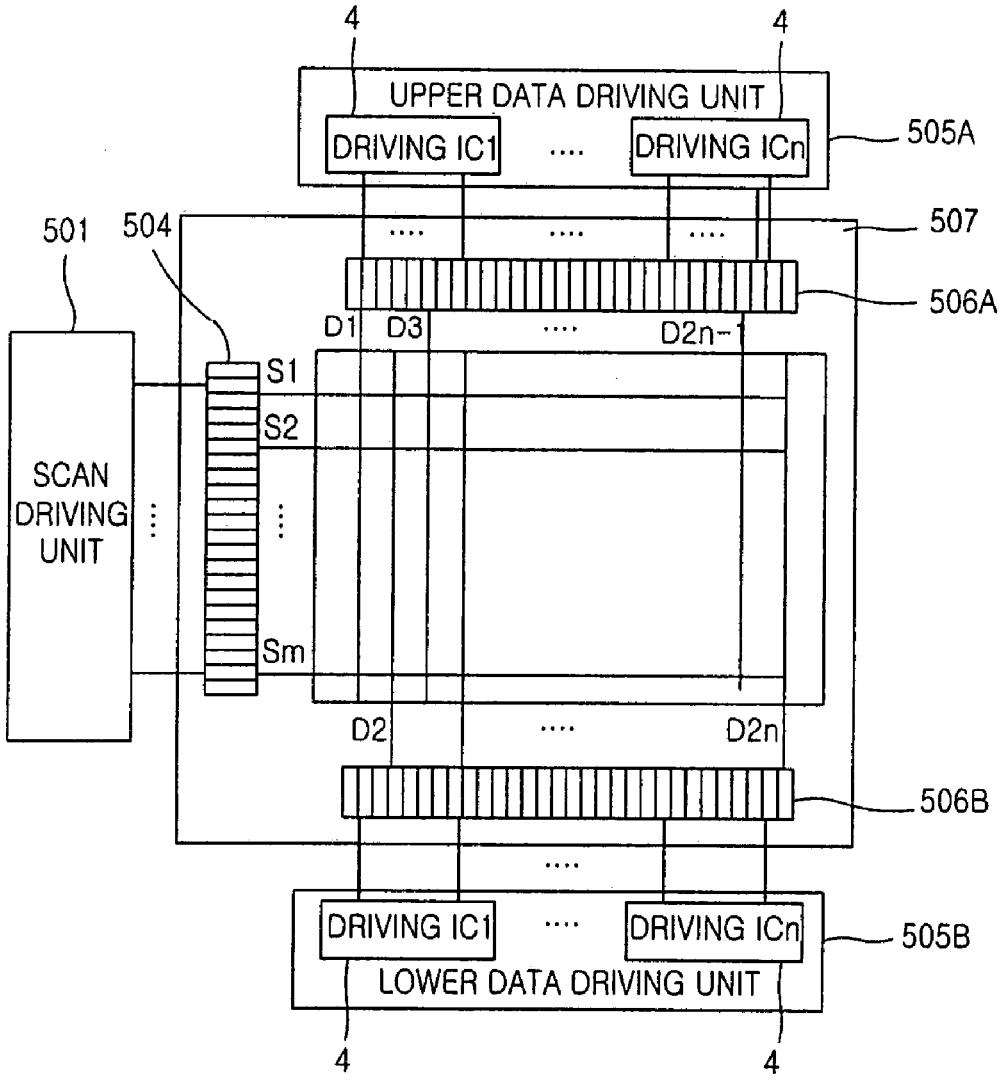
FIG. 9 is a drawing illustrating a third embodiment of the FED in accordance with the present invention.

FIG. 9 is a drawing illustrating a third embodiment of the FED in accordance with the present invention. As shown in the drawing, the FED includes a scan driving unit 501 for driving the scan lines S1, S2, . . . , Sm, upper and lower data driving units 505A and 505B for driving the data lines D1, D2, . . . , Dm, and first to third connectors 506A, 506B and 504 which are formed in the lower substrate 507.

The upper and lower data driving units 505A and 505B supply the data pulse DP to the data lines D1, D2, . . . , Dm according to whether data is supplied. Accordingly, a plurality of integrated circuits 4 (hereinafter, as IC) are mounted corresponding to the number of the cells in the upper and lower data driving units 505A and 505B. Therefore, data lines of odd numbers (D2*n*+1) receives the data pulse from the data driving IC which is respectively mounted in the upper data driving unit 505A and data lines of uneven numbers (D2*n*) receives the data pulse from the lower data driving IC.

The first connector 506A is electrically connected with a data line D2*n*1 of an odd number and electrically connected with the upper data driving unit 505A. That is, the first connector 506A supplies the data pulse DP which is applied from the upper data driving unit 505A to the data line D2*n*+1 of the odd number. The second connector 506B is electrically connected with the data line D2*n* of an uneven number and the lower data driving unit 505B. Namely, the second connector 506B supplies the data pulse DP which is applied from the lower data driving unit 505B to the data line D2*n* of the uneven number. The third connector 504 is electrically connected with the scan lines S1, S2, . . . , Sm and the scan driving unit 501. That is, the third connector 504 supplies a driving signal which is applied from the scan driving unit 501, to the scan lines S1, S2, . . . , Sm.

Figure 10:
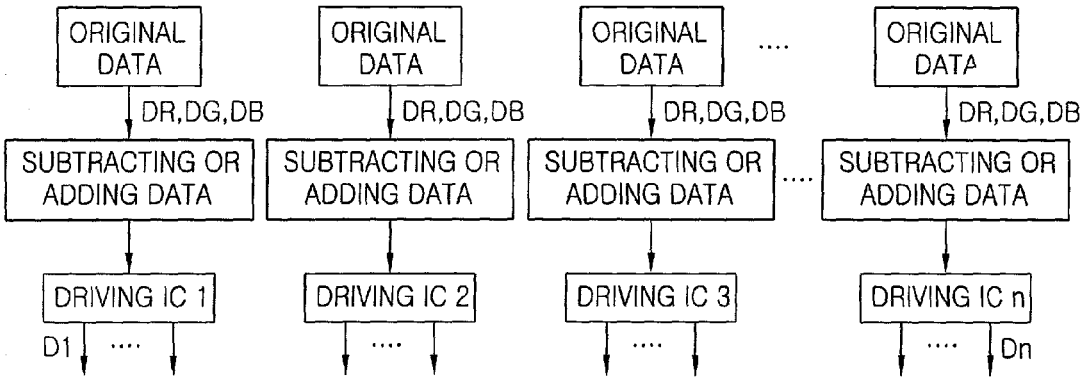
FIG. 10 is a schematic diagram for describing the third embodiment of the FED in accordance with the present invention.

FIG. 10 is a schematic diagram for describing the third embodiment of the FED in accordance with the present invention. As shown in the drawing, the driving method for the FED in accordance with the embodiment of the present invention can obtain a uniform image by compensating the data information of the inputted image signals R, G and B according to voltage descending in the distance from the scan driving unit 501 to the data converting unit, and supplying the information to the screen. That is, the FED converts the image signals R, G and B which are inputted from a video card which is not shown into digital signals and compensates the information of the image signals R, G and B according to the position of the screen by subtracting or adding the converted digital image signals R, G and B in the data processing unit again. The compensated image signals R, G and B are supplied to the data driving IC (IC1 to ICn) corresponding to the respective positions and compensates actual voltage descending according to the distance from the scan driving unit 501.

Figure 11:
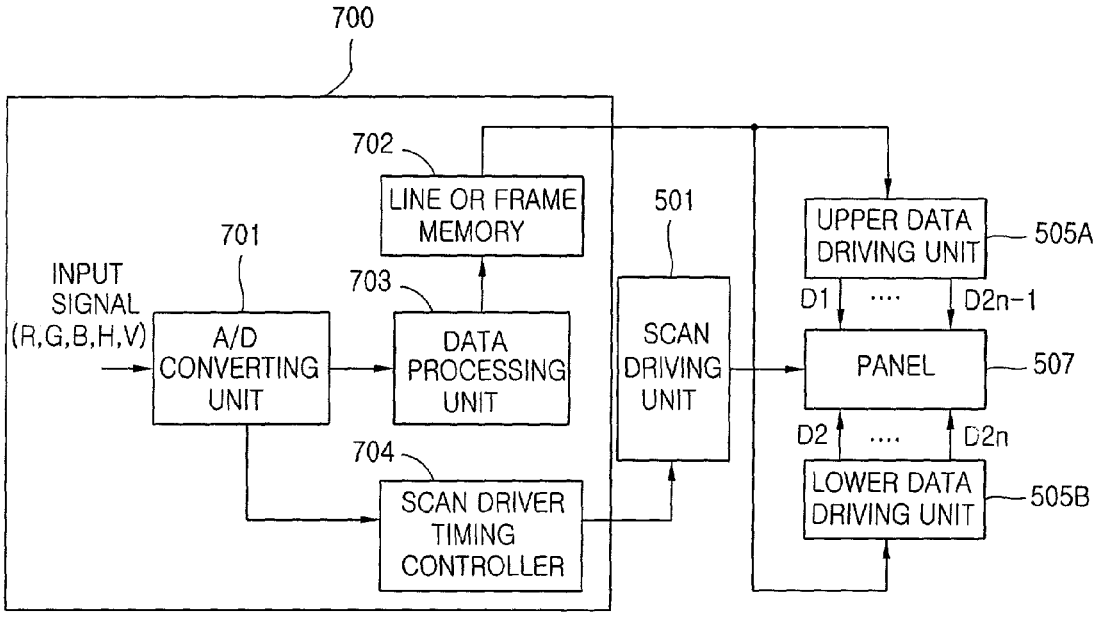
FIG. 11 is a block diagram showing a driving circuit of FED in accordance with the third embodiment.

FIG. 11 is a block diagram showing a driving circuit of FED in accordance with the third embodiment. As shown in the drawing, the FED includes a scan driving unit 501 for driving the scan lines S1, S2, . . . , Sm upper and lower data driving units 505A and 505B for driving the data lines D1, D2, . . . , Dm, and a data converting unit 700 for subtracting and adding a voltage which is applied to the scan lines S1, S2, . . . , Sm or data lines D1, D2, . . . , Dm.

Also, the data converting unit 700 includes an A/D converter 701 for converting the inputted image signals R, G and B into digital image signals DR, DG and DB, data processing unit 703 for compensating voltage descending of the data information digital image signals DR, DG and DB which are supplied from the A/D converting unit 701, according to the respective positions of the panel, a line or frame memory 702 for temporarily storing data information supplied from the data processing unit 703, upper and lower data driving units 505A and 505B for supplying data-processed data information supplied from the line or frame memory 702 to the respective corresponding data lines D1, D2, . . . , Dm.

The A/D converting unit 701 receives analog red, green and blue image signals and vertical and horizontal synchronous signals V and H from an image supply unit which is not shown, converts the signals into digital image signals DR, DG and DB, and supplies to the data processing unit 703. Also, the A/D converting unit 701 supplies a driving control signal to a scan drive timing controller 704 which is installed between the A/D converting unit 701. The scan drive timing controller 704 generates control signals for controlling the scan driving unit 501 and supplies the signals to the scan driving unit 501. The scan driving unit 501 supplies the scanning signals which are generated by the control signal of the scan drive timing controller 704 to the scan lines S1, S2, . . . , Sm.

The data processing unit 703 is a kind of EEPROM (electrically erasable programmable read-only memory) and compensates data information by adding or subtracting the data information according to the predetermined data value, that is, a look up table. At this time, the values of the look up table are composed of values for compensating voltage descending of the digital image signals DR, DG and DB which are supplied from the A/D converting unit 701, according to the position from the scan driving unit 501. That is, the data processing unit 701 adds or subtracts the values of the digital image signals DR, DG and DB according to the position of the panel.

Accordingly, the values of the digital image signals DR, DG and DB are converted by being compensated with the value of the data information corresponding to the position of the panel by the data processing unit 701. Then, the line or frame memory temporarily stores the converted digital image signals DR, DG and DB from the data processing unit 701 and supplies the signals to the driving ICs of respective lines or frames. Also, the driving ICs compensate voltage descending of the digital image signals DR, DG and DB supplied from the line or frame memory according to the actual position of the panel.

Figure 12:
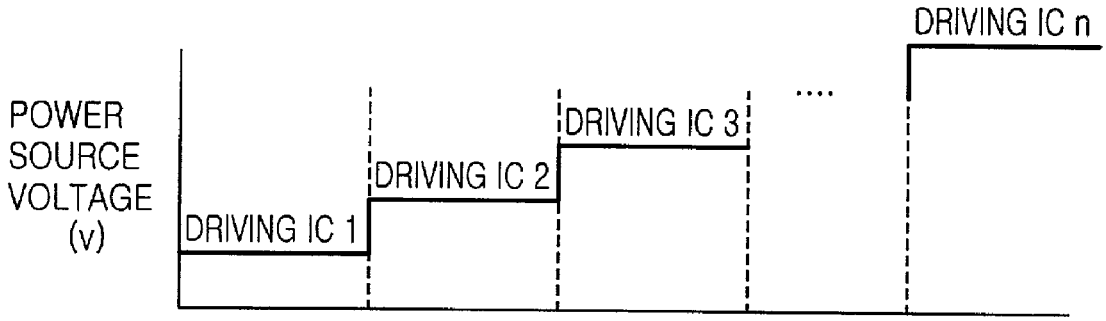
FIG. 12 is a drawing illustrating waveforms of a driving voltage level which is supplied to upper and lower data driving units shown in FIG. 9.

FIG. 12 is a drawing illustrating waveforms of a driving voltage level which is supplied to upper and lower data driving units shown in FIG. 9. As shown in the drawing, the driving method for the FED in accordance with the third embodiment of the present invention will be described, a driving power source voltage which is applied to drive the data driving ICs which are mounted inside the upper and lower data driving units 505A and 505B, is applied to respective data driving ICs to have voltage differences. For instance, since the upper and lower data driving units 505A and 505B are respectively connected to 960 data lines if the cells have a resolution of a VGA (Video Graphics Array) level, respective data driving units 505A and 505B need 10 driving ICs which have at least 100 outputs. Also, driving power source voltage which is applied to the second data driving IC IC2 is applied more highly than that of the first data driving IC IC1 and the driving power source voltage is applied more highly along to the nth data driving IC ICn. That is, the data lines which are connected to the first data driving IC IC1 are positioned near from the scan driving unit 501 and line resistance value is very small. Accordingly, a relatively low driving power source voltage is applied. On the other hand, the data lines which are connected to the nth data driving IC ICn are positioned far from the scan driving unit 501 and line resistance value is very large. Therefore, a relatively high driving power source voltage is applied to compensate the resistance value. At this time, the driving power source voltage which is applied to the respective data driving IC is determined by taking the current which flows in the scan lines S1, S2, . . . , Sm and voltage descending into consideration sufficiently.

Also, the driving power source voltage is applied in the shape that it is linearly increased from the first data driving IC IC1 to the nth data driving IC ICn. As described above, the driving power source voltage is compensated according to the resistance value of the scan lines S1, S2, . . . , Sm. Therefore, since the resistance of the scan lines S1, S2, . . . , Sm is high and the current is large, voltage descending by the resistance of the scan lines S1, S2, . . . , Sm can be prevented according to position of the screen when a voltage is applied to the scan lines S1, S2, . . . , Sm. Therefore, brightness of the whole cells can become uniform.

Figure 13:
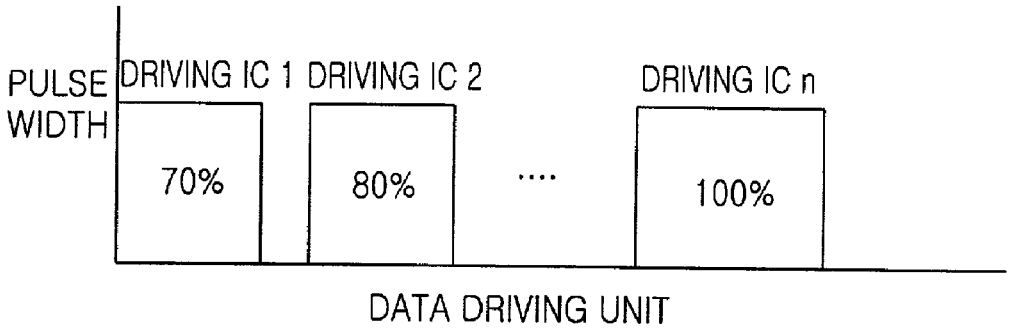
FIG. 13 is a drawing illustrating waveforms of a pulse width of the driving voltage which is supplied to upper and lower data driving units shown in FIG. 9.

FIG. 13 is a drawing illustrating waveforms of a pulse width of the driving voltage which is supplied to upper and lower data driving units shown in FIG. 9. As shown in the drawing, in the FED, the pulse width of the driving voltage which is supplied to the respective data driving ICs which are mounted in the upper and lower data driving unit 505A and 505B can be differently modulated (PWM; Pulse Width Modulation) and supplied to the data lines D1, D2, . . . , Dm. That is, a driving voltage having a larger pulse width than the first data driving IC IC1 is applied to the second data driving IC IC2 and a driving voltage having a gradually larger pulse width is applied along to the nth data driving IC ICn. At this time, driving power source voltage which is supplied to the data driving IC IC1 to ICn is fixed to a voltage level.

In other words, the data lines which are connected to the first data driving IC IC1 are positioned near from the scan driving unit 501 and have very small resistance values. Therefore, the lines have a relatively small pulse width (70%). The data lines which are connected to the nth data driving IC ICn are positioned far from the scan driving unit

501 and the line resistance value is very large. Therefore, the lines have a large pulse width (100%) by compensating the resistance value. At this time, the pulse width which is applied to the respective driving ICs is determined as pulse widths which gradually increase in the respective positions after determining the difference of the scan lines S1 , S2, . . . , Sm and position of the screen.

As described above, the pulse width of the driving voltage which is supplied to the data driving ICs is differently supplied according to the distance from the scan driving unit 501 and accordingly, brightness of left and right side of the screen can become uniform by compensating voltage descending according to the position of the screen.

As described above, the field emission display device and driving method for the same in accordance with the present invention can reduce power consumption, display an image of a uniform brightness regardless of the position of the screen, and manufacture the device as a large screen.

Also, the field emission display device and driving method for the same in accordance with the present invention can maintain the brightness of the whole screen uniformly by differently supplying the driving voltage and pulse width of the driving voltage which are supplied to the data driving driver according to the position of the data line, and compensating voltage descending caused by difference in the resistance according to the position of the scan line by converting the inputted data value.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A field emission display FED device, comprising:

data lines formed in a panel;

scan lines formed in a direction crossing the data lines in the panel;

a first connector installed at an end of the data lines and electrically connected with the data lines;

a second connector installed at an end of the scan lines and electrically connected with the scan lines;

a printed circuit board installed on a rear surface of the panel;

a third connector installed at the other end of the scan lines and electrically connected with the scan lines;

auxiliary electrodes installed in parallel with the scan lines in the printed circuit board;

first and second joints installed at an end of the printed circuit board and electrically connected with the auxiliary electrodes; and a third joint installed at the other end of the printed circuit board and electrically connected with the auxiliary electrodes.

2. The device of claim 1, wherein the auxiliary electrodes are formed with a wider width than that of the scan lines.

3. The device of claim 1, wherein the auxiliary electrodes are formed thicker than the scan lines.

4. The device of claim 1, wherein the first and second joints are electrically connected with the second connector and the third joint is electrically connected with the third connector.

5. The device of claim 1, further comprising:

a data driving unit electrically connected to the first connector and configured to supply a data pulse to the first connector; and a scan driving unit electrically connected to the first joint and configured to sequentially supply scan pulses to the first joint.

* * * * *